United States Patent [19]

Bates et al.

[11] Patent Number: 4,764,230

[45] Date of Patent: Aug. 16, 1988

[54] EXPLOSIVE COMPOSITION

[75] Inventors: Andrew Bates, West Melton; Stuart Dack, Graham Roads Rosanna; David Yates, East Brunswick, all of Australia

[73] Assignee: ICI Australia Operations Proprietary Ltd., Victoria, Australia

[21] Appl. No.: 89,394

[22] Filed: Aug. 26, 1987

[30] Foreign Application Priority Data

Aug. 26, 1986 [AU] Australia ..... PH7651

[51] Int. Cl.[4] ..... C06B 45/02

[52] U.S. Cl. ..... 149/21; 149/2; 149/109.6

[58] Field of Search ..... 149/2, 21, 109.6

[56] References Cited

U.S. PATENT DOCUMENTS

| | | | |
|---|---|---|---|
| 4,343,663 | 8/1982 | Breza et al. | 149/21 |
| 4,357,184 | 11/1982 | Binet et al. | 149/2 |
| 4,394,198 | 7/1983 | Takeuchi et al. | 149/21 |
| 4,414,044 | 11/1983 | Takeuchi et al. | 149/2 |
| 4,420,349 | 12/1983 | Bampfield | 149/2 |
| 4,473,418 | 9/1984 | Bampfield et al. | 149/2 |
| 4,525,225 | 6/1985 | Cechanski | 149/2 |
| 4,632,714 | 12/1986 | Abegg et al. | 149/2 |
| 4,678,524 | 7/1987 | Cranney et al. | 149/2 |
| 4,708,753 | 11/1987 | Forsberg | 149/2 |

FOREIGN PATENT DOCUMENTS 60-90888 5/1985 Japan .

*Primary Examiner*—Stephen J. Lechert, Jr.
*Attorney, Agent, or Firm*—Cushman, Darby & Cushman

[57] ABSTRACT

A water-in-oil emulsion explosive composition comprising: a discontinuous aqueous oxidizer-phase comprising dissolved therein an oxygen releasing salt component comprising ammonium nitrate; a continuous organic-phase comprising an organic fuel; and an emulsifying agent and characterized in that the oxygen-releasing salt component comprises at least one modifier selected from compounds of elements selected from the group consisting of aluminium, iron and silicon and wherein the oxidizer-phase comprises dissolved therein at least one polycarboxylate compound selected from polycarboxylic acids and salts thereof.

37 Claims, No Drawings

EXPLOSIVE COMPOSITION

This invention relates to an explosive composition and in particular an emulsion explosive composition comprising a discontinuous oxidiser phase and a continuous fuel phase and a process for preparation thereof.

Emulsion explosive compositions have been widely accepted in the explosives industry because of their excellent explosive properties and ease of handling. Commercially-available explosive compositions are generally of the water-in-oil type comprising (a) a discontinuous aqueous oxidizer-phase comprising discrete droplets of an aqueous solution of inorganic oxygen-releasing salts; (b) a continuous water-immiscible organic phase throughout which the droplets are dispersed and (c) an emulsifier which forms an emulsion of the droplets of oxidizer salt solution throughout the continuous organic phase. Examples of water-in-oil emulsion compositions are described in U.S. Pat. No. 3,447,978.

For some applications, the water content of the oxidizer phase of the emulsion explosive may be reduced to a low level, for example to less than 4% by weight of the total emulsion.

In general, the purity of the oxygen-releasing salt solution has a large bearing on the stability of the emulsion explosive.

The presence of additives or impurities in the oxidizer phase can cause deterioration of the explosive as a result of the formation and growth of crystal matrices in the oxidizer-phase.

Consequently it has heretofore been necessary to use relatively pure oxygen-releasing salt in the oxidizer-phase.

Ammonium nitrate, which is the most commonly used oxidizer salt, is hydroscopic and exhibits a tendency to cake, and in tropical climates this causes considerable storage and handling problems.

The use of modifiers such as the salts of iron and aluminum in ammonium nitrate compositions is known in the art. The presence of such modifiers in compositions of particulate or prilled ammonium nitrate has the significant advantage of enhancing mechanical strength of the prills giving the composition a high resistance both prill breakdown during handling and to caking on storage. Examples of ammonium nitrate compositions comprising modifiers such as oxides, sulphates or hydroxides of iron and aluminium are described in Australian Patent Nos. 436409 and 484229 and U.S. Pat. No. 4,268,490 together with methods for their preparation.

Despite the considerable handling advantages of such ammonium nitrate compositions it has not heretofore been possible to prepare stable emulsion explosives using them as a component of the aqueous oxidizer-phase.

Although the presence of the modifiers is particularly beneficial in transport and bulk handling they considerably reduce or even destroy the usefulness of these ammonium nitrate compositions in the oxidizer-phase of emulsion explosives.

Surprisingly we have now found that this convenient form of ammonium nitrate may be used in the oxidizer-phase of emulsion explosives and provides products of excellent stability if the oxidizer phase also contains a compound selected from polycarboxylic acids and salts thereof.

Accordingly we provide a water-in-oil emulsion explosive comprising: a discontinuous aqueous oxidizer-phase comprising dissolved therein an oxygen-releasing salt component comprising ammonium nitrate; a continuous organic-phase comprising an organic fuel; and an emulsifying agent, and characterized in that the oxygen releasing salt component comprises at least one modifier selected from the compounds of the elements selected from the group consisting of aluminium, iron and silicon, and wherein the oxidizer-phase comprises dissolved therein at least one polycarboxylate compound selected from polycarboxylic acids and salts thereof.

Where used herein the term "polycarboxylate compound" is used to refer to compounds comprising at least two carboxylate groups per molecule and it will be understood that said polycarboxylate compound may be present in the form of the polycaboxylic acid and/or a salt which may be formed with counter ions present in solution.

For example it will be understood that in solution the polycarboxylate compound may be present as an equilibrium mixture of the free acid and its salts.

Typical examples of counter ions present in solution may be selected from the group consisting of ions of alkali metal and alkaline earth metals and transition metals. Preferred polycarboxylic acids comprise at least 2 carboxylic acid groups which are connected at their shortest link through no more than 3 atoms in sequence and more preferably no more than 2 atoms.

For example, the carboxylic acid groups may be joined directly at the carboxyl carbon (being separated by no atoms), they may be joined through a single atom such as where a single carbon atom (for example a $—CH_2—$ group) is interposed between the two carboxylic acid groups, they may be joined via two atoms in sequence such as two carbon atoms (for example in a $—CH^2—CH^2—$ link) or they may be joined by three atoms.

More preferred carboxylate compounds are chosen from di- and tri-carboxylic acids and their salts. Specific examples of di- and tri-carboxylic acids include oxalic acid, malinic acid, succinic acid, maleic acid, phthalic acid, malic acid, tartaric acid, citric acid and nitrilotriacetic acid.

We have found that citric acid and in particular oxalic acid provide especially good results in the compositions of the present invention.

The optimium concentration of the said polycarboxylate component will depend on the level of strength modifiers which are likely to be present in the emulsion explosive composition. Typically the concentration of the polycarboxylate component will be in the range of from $1\times10^{-4}$% to 10% and preferably 0.01 to 5% by weight based on free acid of the total emulsion explosive (most preferably 0.2 to 2%).

The oxygen-releasing salt component for use in the oxidizer-phase of the composition of the present invention may comprise in addition to ammonium nitrate one or more of the alkali and alkaline earth metal nitrates, chlorates and perchlorates, ammonium chlorate, ammonium perchlorate and mixtures thereof. The preferred oxygen-releasing salt component comprises ammonium nitrate or a mixture of ammonium nitrate and sodium and/or calcium nitrates.

Typically, the said modifier will be present at a concentration of at least 10 parts by weight of said elements per million parts of oxygen-releasing salt component and the concentration is preferably in the range of from 10 to 5000 parts (more preferably 100 to 2000) by weight of said elements per million parts by weight of ammonium nitrate.

Commercially-available modified ammonium nitrate compositions typically contain in the range of from 100 to 2000 parts by weight of said elements per million parts ammonium nitrate.

Preferred modifiers are salts of the elements iron and aluminium. Examples of modifiers may be selected from the group consisting of iron sulphate, ammonium iron sulphate, iron phosphate, aluminium sulphate, ammonium aluminium sulphate, aluminium phosphate and the oxides and hydroxides of the elements iron and aluminium. Such modifiers may be present as hydrated salts. Typical commercially-available modified ammonium nitrate compositions comprise modifiers selected from sulphates, oxides and hydroxides of aluminium. It will be understood that said modifier component may be in the composition in the form of products with counter ions which may be hydrated present in the oxidizer solution.

Typically, the oxygen-releasing salt component of the compositions of the present invention comprises from 45 to 95% and preferably from 60 to 90% by weight of the total composition. In compositions wherein the oxygen-releasing salt comprises a mixture of ammonium nitrate and sodium nitrate, the preferred composition range for such a blend is from 5 to 80 parts of sodium nitrate for every 100 parts of ammonium nitrate. In the preferred compositions of the present invention, the oxygen-releasing salt component comprises from 45 to 90% by weight of the total composition of ammonium nitrate.

Typically, the amount of water employed in the compositions of the present invention is in the range of from 1 to 30% by weight of the total composition and preferably in the range of from 4 to 25%.

The organic-phase component of the composition of the present invention comprises an organic fuel. Suitable organic fuels include aliphatic, alicyclic and aromatic compounds and mixtures thereof which are in the liquid state at the formulation temperature. Suitable organic fuels may be chosen from fuel oil, diesel oil, distillate, kerosene, naphtha, waxes, (e.g. microcrystalline wax, paraffin wax and slack wax) paraffin oils, benzene, toluene, xylenes, asphaltic materials, polymeric oils such as the low molecular weight polymers of olefins, animal oils, fish oils, and other mineral, hydrocarbon or fatty oils, and mixtures thereof. Preferred organic fuels are liquid hydrocarbon generally referred to as petroleum distillates such as gasoline, kerosene, fuel oils and paraffin oils.

Typically, the continuous organic-phase of the emulsion explosive composition of the present invention comprises from 2 to 15% by weight and preferably 3 to 10% by weight of the total composition.

The emulsifying agent component of the composition of the present invention may be chosen from the wide range of emulsifying agents known in the art for the preparation of water-in-oil emulsion explosive compositions. Examples of such emulsifying agents include alcohol alkoxylates, phenol alkoxylates, poly(oxyalkylene) glycols, poly(oxyalkylene) fatty acid esters, amine alkoxylates, fatty acid esters of sorbitol and glycerol, fatty acid salts, sorbitan esters, poly-(oxyalkylene) sorbitan esters, fatty amine alkoxylates, poly(oxyalkylene) glycol esters, fatty acid amides, fatty acid amide alkoxylates, fatty amines, quaternary amines, alkyloxazolines, imidazolines, alkyl-sulfonates, alkylarylsulfonates, alkylsulfosuccinates, lecithin, copolymers of poly (oxyalkylene) glycols and poly(12-hydroxystearic acid) and mixtures thereof. Among the preferred emulsifying agents are the 2-alkyl- and 2-alkenyl-4,4'-bis (hydroxymethyl) oxazoline, the fatty acid esters of sorbitol, lecithin, copolymers of poly(oxyalkylene) glycols and poly(12-hydroxystearic acid), and mixtures thereof, and particularly sorbitan mono-oleate, sorbitan sesquioleate, 2-oleyl- 4,4'-bis(hydroxymethyl) oxazoline, mixture of sorbitan sesquioleate, lecithin and a copolymer of poly-(oxyalkylene glycol, poly(12-hydroxystearic acid), and poly(alkenyl)/succinic acid derivatives such as poly(isobutene) succinic anhydride, and its derivatives (e.g. derivatives formed by reaction with alkanolamines) and mixtures thereof.

Typically, the emulsifying agent component of the composition of the present invention comprises up to 5% by weight of the total composition. Higher proportions of the emulsifying agent may be used and may serve as a supplemental fuel for the composition, but in general it is not necessary to add more than 5% by weight of emulsifying agent to achieve the desired effect. Stable emulsions can be formed using relatively low levels of emulsifying agent and for reasons of economy it is preferable to keep the amount of emulsifying agent used to the minimum required to have the desired effect. The preferred level of emulsifying agent used is in the range from 0.1 to 2.0% by weight of the total composition.

If desired, other optional fuel materials, hereinafter referred to as secondary fuels, may be incorporated into the compositions of the present invention in addition to the water-immiscible organic fuel phase. Examples of such secondary fuels include finely divided solids, and water-miscible organic liquids which can be used to partially replace water as a solvent for the oxygen-releasing salts or to extend the aqueous solvent for the oxygen-releasing salts. Examples of solid secondary fuels include finely divided materials such as: sulfur, aluminium, and carbonaceous materials such as gilsonite, comminuted coke or charcoal, carbon black, resin acids such as abietic acid, sugars such as glucose or dextrose and other vegetable products such as starch, nut meal, grain meal and wood pulp. Examples of water-miscible organic liquids include alcohols such as methanol, glycols such as ethylene glycol, amides such as formamide and amines such as methylamine.

Typically, the optional secondary fuel component of the compositions of the present invention comprise from 0 to 30% by weight of the total composition.

It lies within the invention that there may also be incorporated into the emulsion explosive compositions hereinbefore described other substances or mixtures of substances which are oxygen-releasing salts or which are themselves suitable as explosive materials. As a typical example of such a modified emulsion explosive composition reference is made to compositions wherein there is added to and mixed with an emulsion explosive composition as hereinbefore described up to 90% w/w of a solid particulate oxidizing salt such as ammonium nitrate prills or an explosive composition comprising a mixture of a solid oxidizing salt such as ammonium nitrate and fuel oil and commonly referred to by those skilled in the art as "Anfo". The compositions of "Anfo" are well known and have been described at length in the literature relating to explosives. It also lies within the invention to have as a further explosive component of the composition well-known explosive materials comprising one or more of, for example, trinitrotoluene, nitroglycerine or pentaery- thritol tetranitrate.

Accordingly there is provided an explosive composition comprising as a first component an emulsion explosive composition as hereinbefore described and as a second component an amount of material which is an oxidizing salt or which is in its own right an explosive material.

If desired, the aqueous solution of the compositions of the present invention may comprise optional thickening agents which optionally may be crosslinked. The thickening agents, when used in the compositions of the present invention, are suitably polymeric materials, especially gum materials typified by the galactomannan gum such as locust bean gum or guar gum or derivatives thereof such as hydroxypropyl guar gum. Other useful, but less preferred, gums are the so-called biopolymeric gums such as the heteropolysaccharides prepared by the microbial transformation of carbohydrate material, for example the treatment of glucose with a plant pathogen of the genus Xanthomonas typified by *Xanthomonas-campestris*. Other useful thickening agents include synthetic polymeric materials and in particular synthetic polymeric materials which are derived, at least in part, from the monomer acrylamide.

Typically, the optional thickening agent component of the compositions of the present invention comprises from 0 to 2% by weight of the total composition.

The emulsion explosive compositions of the present invention may additionally comprise a discontinuous gaseous component.

The methods of incorporating a gaseous component and the enhanced sensitivity of emulsion explosive compositions comprising such gaseous components have been previously reported. Typically, where used the said gaseous component will be present in an amount required to reduce the density of the composition to which the range 0.8 to 1.4 gm/cc.

The gaseous component may, for example, be incorporated into the composition of the present invention as fine gas bubbles dispersed through the composition, as hollow particles which are often referred to as microballoons or microspheres, as porous particles, or mixtures thereof.

A discontinuous phase of fine gas bubbles may be incorporated into the compositions of the present invention by mechanical agitation, injection or bubbling the gas through the composition, or by chemical generation of the gas in situ.

Suitable chemicals for the in situ generation of gas bubbles include peroxides, such as hydrogen peroxide, nitrites, such as sodium nitrite, nitrosoamines, such as N, N'-dinitrosopentamethylene-tetramine, alkali metal borohydrides, such as sodium borohydride, and carbonates, such as sodium carbonate. Preferred chemicals for the in situ generation of gas bubbles are nitrous acid and its salts which decompose under conditions of acid pH to produce gas bubbles. Catalytic agents such as thiocyanate or thiourea may be used to accelerate the decomposition of a nitrite gassing agent. Suitable small hollow particles include small hollow microspheres of glass or resinous materials, such as phenol-formaldehyde and ureaformaldehyde. Suitable porous materials include expanded minerals, such as perlite.

Where used, the gaseous agent is preferably added during cooling, after preparation of the emulsion, and typically comprises 0.05 to 50% by volume of the total emulsion explosive composition at ambient temperature and pressure. More preferably, where used, the gaseous component is present in the range 10 to 30% by volume of the emulsion explosive composition and preferably the bubble size of the occluded gas is below 200 μm, more preferably at least 50% of the gas component will be in the form of bubbles or microspheres of 20 to 90 μm internal diameter.

The pH of the emulsion explosive compositions of the present invention is not narrowly critical. However, in general the pH is between 0 to 8, and preferably the pH is between 0.5 and 6.

In the present composition the use of polycarboxylate compounds has the added benefit of allowing the pH control needed where it is desired to use in situ gassing of the emulsion.

Many methods in situ gassing which use chemicals which decompose and release gas bubbles, such as nitrous acid-based gassing agents, require an acid pH in order to function. Thus, the polycarboxylate compounds in the present composition not only allow the use of lower grade and hence less expensive ingredients, but may also be used to control pH where it is desired to use in situ gassing techniques. Furthermore, solid, readily water-soluble acids may be chosen from the polycarboxylic acids of the present invention and it will be understood that such acids will be easier to store and handle on an industrial scale than acids such as nitric acid and acetic acid which have previously been used in emulsion explosives for pH control. However, if desired, conventional acids may be used in addition to the polycarboxylate compounds of the present invention.

In a further embodiment of the invention, we provide a process for preparing a water-in-oil emulsion explosive, the process comprising the steps of:

(a) forming an aqueous oxidizer-phase comprising dissolving an oxygen-releasing salt component comprising ammonium nitrate in an aqueous composition.

(b) emulsifying said aqueous oxidizer-phase in a continuous organic phase comprising an organic fuel and in the presence of an emulsifying agent, and wherein the oxygen-releasing salt component comprises a modifier selected from compounds of the elements selected from the group of aluminium, iron and silicon, and wherein the step of forming the oxidizer phase comprises dissolving in the aqueous composition at least one polycarboxylate compound selected from polycarboxylic acids and salts thereof.

The order of dissolving the oxygen releasing salt component and polycarboxylic component is not critical.

Generally, the oxygen releasing salt component and polycarboxylic component are dissolved in the aqueous composition, which typically consists essentially of water, at a temperature above the fudge point of the salt solution and preferably at a temperature in the range of from 25° to 110° C.

Surprisingly we have found that the stability of the resultant emulsion explosive is particularly improved if the oxidizer-phase pH has been adjusted to below 2 after dissolution of the oxygen releasing salt and polycarboxylic components.

Apparently the effect of the polycarboxylic acid in improving the properties of emulsion explosives prepared using a modifier-containing oxygen-releasing salt is significantly increased if the oxygen-releasing salt component is contacted in solution with the polycarboxylic component at a pH of less than 2 and preferably less than 1.5.

Accordingly we provide in a particularly preferred embodiment of the process of the invention a process as hereinbefore defined wherein in preparation of the oxidizer-phase comprises dissolving said oxygen-releasing salt component and said polycarboxylate component in an aqueous composition and, if the pH of the composition is not below 2 (and preferably 1.5), then lowering the pH of the composition to below 2 (and preferably below 1.5).

Where it is necessary to adjust the pH of the composition this may be achieved by adding a convenient acid such as nitric acid or acetic acid.

It will be understood that where the polycarboxylate component comprises a significant proportion of polycarboxylic acid a pH of less than 2 and preferably less than 1.5 may in many cases be provided without the need for adjustment using another acid.

We have found it to be particularly convenient to use a polycarboxylate component comprising in the range of from 0.5 to 2% w/w of the emulsion explosive of at least one polycarboxylic acid. Typically this will obviate the need for pH adjustment.

Preferred polycarboxylate compounds may be selected from the group consisting of oxalic acid, malinic acid, succinic acid, maleic acid, phthalic acid, malic acid, tartaric acid, citric acid, nitrilotriacetic acid and salts thereof selected from alkali metal and alkaline earth metal salts.

Particularly preferred polycarboxylate compounds are citric acid, oxalic acid, sodium citrate and sodium oxalate. The most preferred polycarboxylate compounds are oxalic acid and citric acid.

The pH effect described above is particularly surprising when it is considered that the effect is maintained even if the pH is subsequently increased to above 1.5 or 2.

This allows a considerable versality in using the preferred embodiment of the process of the present invention. For example, in many cases it will be desired to gas the compositions of the present invention using chemical gassing agents and in many cases it is preferred to carry out gassing operations on compositions in which the oxidizer-phase has a relatively high pH of for example in the range 3 to 6.

It is preferred that the pH of the oxidizer phase is maintained at less than 2 (preferably less than 1.5) for at least 10 minutes prior to emulsifying the oxidizer-phase. More preferably the pH is maintained below 2 (preferably below 1.5) for at least 2 hours. It is preferred that the oxidizer-phase is maintained at a temperature above the fudge point of the salt solution during this period (i.e. for at least 10 minutes and preferably at least 2 hours).

As previously stated the fudge point of the composition is preferably in the range 25° to 110° C. Typically the fudge point of the oxidizer phase will be in the range 40° to 110° C.

As hereinbefore described compositions of the invention may comprise a discontinuous gaseous phase and optionally solid ingredients.

A typical example of a process in which such ingredients may be incorporated comprises the following steps in sequence.

(a) forming an oxidizer phase comprising dissolving the oxygen-releasing salt component and polycarboxylate compound component in water at a temperature above the fudge point of the salt solution;

(b) combining with rapid mixing the organic phase, emulsifying agent and said aqueous salt solution;

(c) mixing until the emulsion is uniform;

(d) mixing into said emulsion a discontinuous gaseous component;

(e) optionally mixing into the emulsion any solid ingredients.

It is preferred that in preparation of the oxidizer-phase the solution is maintained for a period at a pH of below 2 (preferably below 1.5) as hereinbefore discussed.

Ammonium nitrate compositions comprising modifiers are commonly made in the form of prills or particles which as a result of incorporation of the modifiers exhibit a dramatically reduced tendency to both cake in humid conditions and to powdering on response mechanical shock.

In carrying out the process of the present invention using ammonium nitrate in the form of prills containing modifiers, the prills may be dissolved directly in the aqueous composition or may first be crushed to aid dissolution.

The invention is now illustrated by but in no way limited to the following examples in which parts and percentages are on a weight basis unless otherwise specified.

EXAMPLES 1-3 AND COMPARATIVE EXAMPLES (CE) A-D

These Examples compare the stability of the compositions of the present invention comprising emulsion stabilizing di- and poly-carboxylic acids with corresponding compositions in which the nucleation inhibiting agent is replaced by an acid conventionally used for pH control in an emulsion composition.

In order to demonstrate the aluminium additives commonly found as modifiers in commercial available modified ammonium nitrate a modified ammonium nitrate was prepared by mixing chemically pure ammonium nitrate with aluminium sulphate [$Al2(SO_4)_3.14H_2O$] to a level of 700 parts of aluminium per million parts ammonium nitrate.

Emulsion explosives comprising different carboxylic acids (see Table 1) were prepared according to the following procedure:

The modified ammonium nitrate composition (8 parts) was dissolved in water (2 parts) at a temperature of about 80°.

A polycarboxylic acid (X% by weight of the total composition, see table 1) was dissolved in the oxidizer solution (comprising (95-X)% of the total composition) and the pH recorded (pH(i)) and the composition was left overnight at 80° C. Sodium hydroxide was then added to give the final oxidizer phase pH (pH(f)).

The oxidizer-phase was combined with composition of a mixture (comprising 5% of total composition) of Distillate (8 parts) and Sorbitan monooleate emulsifier (2 parts) and the mixture was stirred rapidly to form an emulsion.

Portion of the emulsion was placed in cold storage (2° C.) overnight and the remainder was kept at 50° C. for a period of 5 weeks.

The sample maintained overnight at 2° C. was examined using a microscope at 114× magnification and the degree of crystallization observed. The sample maintained at 50° C. was examined in the same way after 1 week, 2 weeks and 5 weeks.

The degree of crystallisation which was observed is recorded in the table below using the following symbols.

0—no apparent crystallization

X—slight crystallization

XX—significant crystallization

XXX—very bad crystallization xxxx—substantially complete crystallization dnf—emulsion failed to form after rapid mixing

TABLE 1

| Example | Carboxylic Acid | X % | pH (i) | pH (f) | Crystallization o/n 2% | 1 wk 50° C. | 2 wks 50° C. | 5 wks 50° C. |
|---|---|---|---|---|---|---|---|---|
| 1 | NTA # | 0.76 | 1.70 | 4.18 | 0 | 0 | X | X |
| 2 Citric | | 0.84 | 1.70 | 4.37 | 0 | X | XX | XX |
| 3 Oxalic | | 1.01 | 0.40 | 4.34 | 0 | X | XX | XX |
| CE A | Acetic | 0.10% | 2.43 | 4.36 | dnf | — | — | — |
| CE B | Acetic | 0.84 | 1.70 | 4.37 | dnf | — | — | — |
| CE C | Acetic | 1.44 | 1.85 | 4.27 | XXXX | — | — | — |
| CE D | Nitric* | | 3.25 | 4.24 | X | XX | XX | XXX |

*pH was adjusted using nitric acid to give a pH of 3.25 before addition of sodium hydroxide.
NTA —nitrilotriacetic acid.
Note:
Oxalic acid added in the form oxalic acid dihydrate (MW 12607). Citric acid added in the form of citric acid monohydrate (MW 210.14).
Percentage weights are calculated on the basis of the free acid.

The above examples demonstrate the improved stability of the composition of the present invention comprising dicarboxylic acids or polycarboxylic acids over corresponding compositions comprising acids previously used for pH control in emulsion explosive compositions.

EXAMPLES 4 and 5 AND COMPARATIVE EXAMPLES (CE) E AND F

The procedure of Examples 1–3 was repeated except that in Example CE 5 0.1% by weight of total emulsion compositions of an additional anticaking agent was added to the modified ammonium nitrate.

TABLE 2

| Example | Crystallization Anti Caking Agent* | Acid | Oxidizer solution | pH (i) | pH (f) | o/n 2° C. | 2 wks 50° | 5 wks 50° | 10 wks 50° |
|---|---|---|---|---|---|---|---|---|---|
| 4 | 0 | Citric 0.42% | 94.58 | 1.25 | 4.33 | 0 | 0 | 0 | 0 |
| CE E | 0 | Acetic 0.12 | 94.88 | 2.38 | 4.26 | 0 | X | XX | XXX |
| 5 | 0.1% | Citric 0.42% | 94.57 | 1.24 | 4.34 | 0 | X | X | X |
| CE F | 0.1% | Acetic 0.12% | 94.87 | 2.37 | 4.34 | X | XX | XXX | — |

*A stearic acid based anticaking agent was used.

EXAMPLES 6–8 AND COMPARATIVE EXAMPLES (CE) G AND H

The procedure of Examples 1–3 was repeated replacing the modified ammonium nitrate composition with "Nitropril" ammonium nitrate prills ("Nitropril" is a trade mark) which are made by the "Topan" process, and comprise hydrated aluminium sulphate at a concentration in the range of from 500 to 800 parts aluminium ion per million parts ammonium nitrate and a stearic acid based anticaking agent.

TABLE 3

| Example | Acid % | X % | pH (i) | pHf | Crystallization o/n 2% | 1 wk 50° C. | 5 wks 50° C. | 10 wks 50° C. |
|---|---|---|---|---|---|---|---|---|
| 6 | Oxalic | 1.01 | 0.00 | 4.52 | 0 | 0 | 0 | 0 |
| 7 | Oxalic | 1.01 | 0.27 | 1.97 | 0 | 0 | X | X |
| 8 | NTA | 1.52 | 1.02 | 4.54 | 0 | X | X | XXXX |
| 9* | Oxalic | 1.01 | 0.02 | 2.03 | 0 | 0 | 0 | X |
| CE G | Caproic | 1.94 | 1.50 | 4.48 | dnf | | — | — |
| CE H | Glutonic acid | 1.42 | 1.72 | 4.50 | XXXXX | | — | — |

*Sorbitan monooleate was replaced by an emulsifier prepared by condensing poly(isobutylene)succinic anhydride with ethanolamine in a 1:1 molar ratio.

The above clearly shows improved stability of compositions of the present invention over corresponding composites comprising other carboxylic acids.

EXAMPLES 9 AND 10

The procedure of Examples 1–3 was repeated except that "Nitropril" ammonium nitrate was used and for Example 10 the water used was "hard water" containing 0.01 M total calcium and magnesium presented a 2:1 ratio respectively; and for Example 9 distilled water was used.

The composition in both cases comprised 2.0% Oxalic acid w/w of total composition.

The compositions were stored at 2° C. for 2½ days and were examined under a microscope at 114× magnification. In both cases there was only sign of slight crystallization.

EXAMPLE 11 AND COMPARATIVE EXAMPLE I

EXAMPLE 11

"NITROPRIL" ammonium nitrate (4164 parts), a prilled ammonium nitrate containing in the range of from 500 to 800 ppm of hydrated Aluminium sulphate (based on aluminium ion) calcium nitrate (3715 parts) and citric acid (x parts) was dissolved in water (1253 parts) at a temperature of 80° C. The solution was allowed to stand for 2 hours at 80° and the resulting oxidizer solution was poured into a composition of a mixture of distillate (650 parts) and sorbitan monoleate (130 parts) with rapid mixing.

The compositions were stored at −24° C. for 48 hours and the degree of crystallization compared.

TABLE 4

| Example | Citric Acid X | Crystallization |
|---|---|---|
| 11 | 100 | 0 |
| 12 | 75 | 0 |
| 13 | 50 | 0 |
| 14 | 10 | X |
| CEI | — | XXX |

Compositions prepared according to Example 11 and Comparative Example I were stored at room temperature for 4.6 month. After this period the composition of comparative Example I showed heavily crystallisation to the naked eye. In contrast the composition of Example 11 showed slight crystallization evident by microscopic examination.

EXAMPLE 12

A packaged emulsion explosive product was prepared using the following components according to the procedure detailed below.

| | | Parts |
|---|---|---|
| Oxidizer | "Nitropril"* (Ammonium Nitrate) | 63.82 |
| | Sodium Nitrate | 12.76 |
| | Water | 10.84 |
| | Oxalic acid (as the dihydrate) | 0.76 |
| | Emulsifier Sorbitan monooleate | 1.49 |
| Oil Phase | Paraffin oil | 0.87 |
| | Microcrystalline wax | 1.57 |
| | Paraffin wax | 1.57 |
| Sensitizers | Aluminium - 200 | 3.88 |
| | Microballoons (hydrophobic) | 3.2 |

*The nitropril ammonium nitrate contained in the range of 500 to 800 ppm of hydrated aluminium sulphate (based on aluminium ion).

Oxidizer-Phase Preparation

Components of oxidizer phase were weighed into 1 gallon plastic container with the 0.8% oxalic acid incorporated. These were then heated at 80°-85° C. for four hours with stirring.

After the four hours the pH is adjusted (from <0.5) up to 3.9 with solid sodium hydroxide pellets (Analytical grade).

A "Hobart N50" planetary mixer was used for preparation of the emulsion, in a jacketed stainless steel bowl heated by circulatory water bath.

The waxes were melted in the bowl after which time the paraffin oil and emulsifier are added. These were mixed at speed 2 with a whisk for several minutes after which time the oxidizer was slowly added.

Once all oxidizer was added the mixture is given 2 minutes mixing with whisk at speed 2, then for 10 minutes at speed 3.

The paint fine aluminium and microballoons were added and mixed for a further 2.5 minutes at speed 1 using a paddle giving the final emulsion.

Assessment by Microscopy

A second composition (Comparative Example I) was prepared according to the above procedure except that chemically pure ammonium nitrate was substituted for "NITROPRIL" ammonium nitrate.

Both compositions were stored overnight at −22° C. Neither composition showed any sign of crystal formation.

EXAMPLES 13 TO 15 AND COMPARATIVE EXAMPLE K

Compositions of emulsion explosive containing the following components were prepared according to the procedure outlined below the 'NITROPRIL' composition contained in the range of from 500 to 800 ppm hydrated aluminium sulphate (based on aluminium)

| | Composition Example No | | | |
|---|---|---|---|---|
| | 13 Parts | 14 Parts | 15 Parts | C.E.K Parts |
| Oxidizer-phase | | | | |
| 'Nitropril' ammonium nitrate | 74.708 | 75.57 | 58.98 | 75.54 |
| Water | 18.677 | 18.89 | 14.75 | 19.02 |
| Thiourea | 0.19 | 0.19 | 0.15 | 0.20 |
| Oxalic acid | 0.95 | 0.24 | 0.75 | — |
| Sodium hydroxide | 0.46 | 0.11 | 0.375 | — |
| Fuel oil | 4.17 | 4.17 | 2.97 | 4.17 |
| Emulsifier (sorbitan monooleate) | 0.83 | 0.83 | 0.83 | 0.83 |
| 33% aqueous sodium nitrile | 0.42 | 0.42 | 0.42 | 0.42 |
| ANFO* | — | — | 22.1 | — |

*The ANFO composition used was 'NITROPRIL' ammonium nitrate doped with 6% by weight of fuel oil.

The 'NITROPRIL' composition used in the oxidizer-phase contained ammonium nitrate containing in the range of from 500 to 800 ppm hydrated aluminium sulphate base on aluminium ion.

Preparation

The oxidizer-phase was prepared by dissolving the ammonium nitrate, thiourea and oxalic acid in the water at a temperature of 80° C. The composition was maintained at about 80° C. for 4 hours and the sodium hydroxide was then added to adjust the pH from below 2 to within the range 3.5–4.0.

The oxidizer-phase was then added to a mixture of the fuel oil and emulsifier and the mixture was stirred rapidly to form an emulsion.

The sodium nitrite solution, and where indicated solid, were blended with the composition.

Testing

Detonation tests were performed in duplicate on samples of each of the compositions after periods of storage at ambient temperature using "ANZOMEX" D primers (ANZOMEX is a trade mark) and the bubble energy, shock energy was determined using a 130 mm cardboard cartridge. The critical diameter, below which detonation failed, was also determined.

Results of detonation tests are given for the samples in Tables 5, 6, 7 and 8 for Composition Examples 13, 14, 15, and K respectively.

TABLE 5

| STORAGE (DAYS) | COMPOSITION OF EXAMPLE 13 Primer = ANZOMEX 'D' DENSITY (gm/cc) (under 6 m water) | BUBBLE ENERGY (MJ/KG) | UNCORRECTED SHOCK ENERGY (MJ/KG) | CRITICAL DIAMETER (UNCONFINED mm) |
|---|---|---|---|---|
| 13 | 1.19 | 1.62 | 0.64 | 40 |
| 13 | 1.18 | 1.67 | 0.67 | |
| 19 | 1.12 | 1.82 | 0.75 | 28 |
| 19 | 1.23 | 1.62 | 0.70 | |
| 26 | 1.21 | 1.60 | — | 27 |
| 26 | 1.20 | 1.64 | | |
| 33 | 1.19 | 1.59 | 0.57 (VOD = 5.7) | 37 |
| 33 | 1.19 | 1.63 | 0.66 | |
| 98 | 1.23(1) | 1.57 | 0.65 | 62 |
| 98 | 1.23(1) | 1.58 | 0.66 | |
| 111 | 1.22(1) | 1.48 | 0.64 | — |
| 111 | 1.21(1) | 1.50 | 0.66 | |
| 127 | 1.26(1) | 1.51 | 0.67 | — |
| 127 | 1.27(1) | 1.46 | 0.51 | |

Note:
(1)Detonation carried out under 11 m of water.

TABLE 6

| STORAGE (DAYS) | COMPOSITION OF EXAMPLE 14 Primer = ANZOMEX 'D' DENSITY (gm/cc) (under 11 m water) | BUBBLE ENERGY (MJ/KG) | UNCORRECTED SHOCK ENERGY (MJ/KG) | CRITICAL DIAMETER (UNCONFINED mm) |
|---|---|---|---|---|
| 8 | 1.20 | 1.65 | 0.54 | 33 |
| 8 | 1.19 | 1.73 | 0.62 | |
| 15 | 1.21 | 1.65 | 0.47 | 48 |
| 15 | 1.24 | 1.60 | 0.72 | |
| 21 | 1.21 | 1.69 | 0.65 | 45 |
| 21 | 1.91 | 1.64 | 0.53 | |
| 27 | 1.24 | 1.65 | 0.59 | — |
| 27 | 1.17 | 1.65 | 0.53 | |
| 33 | 1.19 | 1.54 | 0.58 | 70 |
| 33 | 1.13 | 1.49 | 0.57 | |
| 62 | 1.23 | 0.18 | 0.04 | |
| 62 | 1.23 | 0.13 | 0.03 | |

TABLE 7

| STORAGE (DAYS) | COMPOSITION OF EXAMPLE 15 Primer = ANZOMEX 'D' DENSITY (gm/cc) (under 11 m water) | BUBBLE ENERGY (MJ/KG) | UNCORRECTED SHOCK ENERGY (MJ/KG) | CRITICAL DIAMETER (mm) |
|---|---|---|---|---|
| 7 | 1.12 | 1.71 | 0.52 | 33 |
| 7 | 1.13 | 1.69 | 0.59 | |
| 14 | 1.16 | 1.59 | 0.63 | 40 |
| 14 | 1.15 | 1.63 | 0.65 | |
| 20 | 1.12 | 1.73 | 0.67 | 66 |
| 20 | 1.16 | 1.69 | 0.66 | |
| 26 | 1.16 | 1.82 | 0.61 | — |
| 26 | 1.19 | 1.52 | 0.41 | |
| 32 | 1.14 | 1.70 | 0.72 | 64 |
| 61 | 1.12 | 0.39 | 0.08 | |
| 61 | 1.17 | 0.83 | 0.19 | |

TABLE 8

| STORAGE (DAYS) | COMPOSITION OF EXAMPLE K Primer = ANZOMEX D DENSITY (G/CC) (UNDER 11 m WATER) | BUBBLE ENERGY (MJ/KG) | UNCORRECTED SHOCK ENERGY (MJ/KG) | CRITICAL DIAMETER (mm) |
|---|---|---|---|---|
| Fresh | 1.18 | 1.70 | 0.64 | 32 |
| 20 days | 1.19 | 1.48 | 0.39 | 65 |
| 5 days | 1.18 | 0.42 | 0.16 | — |

The above experiments clearly demonstrate the improvement provided by the compositions of the invention.

The composition of Comparative Example K which comprises as a component of the oxidizer-phase "Nitropril" ammonium nitrate which contains an aluminium oxide modifier present at a concentration of about 600 to 800 ppm of aluminium ion performed poorly after 5 days storage indicating a serious deterioration in explosive performance at between 2 and 5 days storage.

In contrast corresponding compositions comprising 0.95 and 0.24% by weight of dissolved oxalic acid were stored for many weeks with no significant deterioration in performance.

The Composition Example 13, for example, which contained 0.95% by weight of oxalic acid performed satisfactorily after 127 days storage.

We claim:

1. A water-in-oil emulsion explosive composition comprising: a discontinuous aqueous oxidizer-phase comprising dissolved therein an oxygen releasing salt component comprising ammonium nitrate; a continuous organic-phase comprising an organic fuel; and an emulsifying agent and characterised in that the oxygen-releasing salt component comprises at least one modifier selected from compounds of elements selected from the group consisting of aluminium, iron and silicon and wherein the oxidizer-phase comprises dissolved therein at least one polycarboxylate compound selected from polycarboxylic acids and salts thereof.

2. An explosive composition according to claim 1 wherein said carboxylic acids comprise at least two carboxylic acid groups which are connected at their shortest link through no more than 2 carbon atoms.

3. An explosive composition according to claim 1 wherein said carboxylic acids are selected from di- and tri- carboxylic acids.

4. An explosive composition according to of claim 3 wherein said carboxylic acids are selected from the group consisting of oxalic acid, malinic acid, succinic acid, maleic acid, phthalic acid, malic acid, tartaric acid, citric acid and nitrilotriacetic acid.

5. An explosive composition according to claim 4 wherein said carboxylic acids are selected from citric acid and oxalic acid.

6. An explosive composition according to claim 1 wherein said polycarboxylate compound conponent is present at a concentration in the range of from $1\times10^{-4}$% to 10% by weight of the total emulsion explosive based on the weight of the free polycarboxylic acid.

7. An explosive composition according to claim 6 wherein said range is 0.01% to 5%.

8. An explosive composition according to claim 1 wherein the said modifier is present at a concentration of at least 10 parts by weight of said element per million parts of said oxygen-releasing salt component.

9. An explosive composition according to claim 8 wherein said concentration is in the range of from 100 to 2000 parts per million.

10. An explosive composition according to claim 1 wherein said modifier is selected from the sulphates, oxides and hydroxides of the elements aluminium and iron.

11. An explosive composition according to claim 10 wherein said element is aluminium.

12. An explosive composition according to claim 1 wherein the oxygen releasing salt component comprises in the range of from 45 to 95% by weight of the total emulsion explosive composition.

13. An explosive composition according to claim 1 wherein said organic fuel is selected from the group consisting of fuel oil, diesel oil, distillate, kerosene, naphtha, waxes, paraffin oils, benzene, toluene, xylenes, asphaltic materials, polymeric oils, animal oils, fish oils and mixtures thereof.

14. An explosive composition according to claim 13 wherein the organic fuel is selected from the group consisting of fuel oil, diesel oil, distillate, furnace oil, sump oil, waxes, and paraffin oil.

15. An explosive composition according to claim 1 wherein the organic-phase comprises from 2 to 15% by weight of the total composition.

16. An explosive composition according to claim 1 wherein said emulsifying agent is selected from the group consisting of alcohol alkoxylates, phenol alkoxylates, poly(oxyalkylene) sorbitan esters, fatty amine alkoxylates, poly(oxyalkylene) glycol esters, fatty acid amides, fatty acid amide alkoxylates, fatty amines, quaternary amines, alkyloxazolines, alkenyloxazolines, imidazolines, alkylsulfonates, alkylarylsulfonates, alkylsulfosuccinates, alkylphosphates, alkenylphosphates, phosphate esters, lecithin, copolymers of poly(oxyalkylene) glycols, poly(12-hydroxystearic acid), poly(alkenyl)-succinic anhydride and derivatives thereof, and mixture thereof.

17. An emulsion explosive composition according to claim 16 wherein said emulsifying agent is selected from the group consisting of sorbitan mono-oleate, sorbitan sesquioleate, 2-oleyl-4,4'-bis-(hydroxymethyl) oxazoline, a mixture of sorbitan sesquioleate, lecithin and a copolymer of poly(oxyalkylene) glycol and poly (12-hydroxystearic acid), poly(isobutylene) succinic anhydride and derivatives thereof.

18. An explosive composition according to claim 1 wherein said emulsifying agent comprises from 0.1 to 2.0% by weight of the total composition.

19. An explosive composition according to claim 1 wherein the oxidizer-phase phase comprises from 1 to 30%, by weight of the total composition of water.

20. An explosive composition according to claim 1 wherein sufficient discontinuous gaseous phase is used to give a composition having a density in the range of from 0.7 to 1.4 g/cm$^3$.

21. An explosive composition comprising as a first component an emulsion explosive composition as defined according to claim 1 and as a second component an amount of material which is an oxidizing salt or which in its own right is an explosive material.

22. An explosive composition according to claim 1 having a pH in the range of from 0.5 to 6.

23. A process for the preparation of an emulsion explosive according to claim 1 the process comprising:

(a) forming an aqueous oxidizer-phase comprising dissolving an oxygen-releasing salt component comprising ammonium nitrate in an aqueous composition and (b) emulsifying said aqueous oxidizer-phase in a continuous organic-phase comprising an organic fuel and in the presence of an emulsifying agent and wherein the oxygen-releasing salt component comprises a strength modifier selected from compounds of the elements selected from the group of aluminium, iron and silicon and wherein the step of forming the oxidizer-phase comprises dissolving in the aqueous composition at least one polycarboxylate compound selected from polycaboxylic acids and salts thereof.

24. A process according to claim 23 wherein preparation of the oxidizer-phase comprises dissolving said oxygen-releasing salt component and said polycaboxylate component in an aqueous composition, and if the pH of the solution is not below 2, then lowering the pH of composition to below 2.

25. A process according to claim 23 wherein the said oxygen releasing salt component comprises ammonium nitrate containing modifier at a concentration in the range of from 100 to 2000 parts by weight of said elements per million parts of said ammonium nitrate.

26. A process according to claim 23 wherein the polycarboxylate compound component comprises at least one compound selected from the group consisting of oxalic acid, malinic acid, succinic acid, maleic acid, tartaric acid, citric acid, nitrilotriacetic acid and salts thereof selected from the alkali metal and alkaline earth metal salts.

27. A process according to claim 26 wherein the polycarboxylate component comprises at least one compound selected from oxalic acid, citric acid and the sodium and potassium salts of oxalic and citric acid.

28. A process according to claim 26 wherein the polycarboxylate component comprises oxalic acid or citric acid.

29. A process according to claim 26 wherein the polycarboxylate component is oxalic acid.

30. A process according to claim 24 wherein the step of forming the oxidizer-phase comprises dissolving the oxygen-releasing salt component and the carboxylate component in an aqueous composition and maintaining the pH of the solution below 2 for a period of at least 10 minutes.

31. A process according to claim 30 wherein the pH is maintained below 1.5 for a period of at least 10 minutes.

32. A process according to claim 30 wherein the solution is maintained below said pH for at least 1 hour.

33. A process according to claim 30 wherein after maintaining the pH below at least 2 for said period, the pH is increased to within the range of from 3 to 6.

34. A process according to claim 23 wherein the fudge point of the salt solution is in the range 40° to 100° C.

35. A process according to claim 23 wherein said process comprises (a) forming an oxidizer phase comprising dissolving the oxygen releasing salt component and polycarboxylate compound component in water at a temperature above the fudge point of the salt solution.

(b) combining with rapid mixing the organic phase, emulsifying agent and said aqueous salt solution.

(c) mixing until the emulsion is uniform.

(d) mixing into said emulsion a discontinuous gaseous component.

(e) optionally mixing into the emulsion any solid ingredients.

36. A process according to claim 35 wherein the discontinuous gaseous phase comprises microballoons or gas bubbles generated in situ by chemical means.

37. An explosive composition prepared by a process according to claim 23.

* * * * *